US011767040B2

(12) United States Patent
King et al.

(10) Patent No.: US 11,767,040 B2
(45) Date of Patent: Sep. 26, 2023

(54) BOGIE FRAME WITH ASYMMETRICAL SUPPORT BEAM AND BOGIE OF A RAIL VEHICLE

(71) Applicant: Bombardier Transportation GmbH, Berlin (DE)

(72) Inventors: Paul King, Derby (GB); Philip Adams, Silkstone (GB)

(73) Assignee: Bombardier Transportation GmbH, Berlin (DE)

( * ) Notice: Subject to any disclaimer, the term of this patent is extended or adjusted under 35 U.S.C. 154(b) by 264 days.

(21) Appl. No.: 17/137,540

(22) Filed: Dec. 30, 2020

(65) Prior Publication Data

US 2021/0197871 A1 Jul. 1, 2021

(30) Foreign Application Priority Data

Dec. 31, 2019 (GB) ..... 1919475

(51) Int. Cl.
*B61F 3/04* (2006.01)
*B61F 5/52* (2006.01)

(52) U.S. Cl.
CPC . *B61F 3/04* (2013.01); *B61F 5/52* (2013.01)

(58) Field of Classification Search
CPC ..... B61F 3/04; B61F 5/52; B61F 5/04; B61F 5/38; B61F 5/40; B61C 9/50; B61C 3/00
See application file for complete search history.

(56) References Cited

U.S. PATENT DOCUMENTS 9,096,240 B2 8/2015 Rodet
2013/0019774 A1* 1/2013 Ahuja ..... B61C 9/50 105/133

FOREIGN PATENT DOCUMENTS

CN 204750185 U * 11/2015
CN 108297891 A * 7/2018 ..... B61F 5/02

* cited by examiner

*Primary Examiner* — Mark T Le
(74) *Attorney, Agent, or Firm* — The Webb Law Firm

(57) ABSTRACT

A unitary bogie frame for a bogie of a rail vehicle, includes: two side beams and at least one support beam extending in the transverse direction of the bogie frame and rigidly connected to each of the two side beams. The support beam includes a support portion for supporting a drive unit of the bogie and a slender portion. The support portion is directly connected to one of the two side beams and is connected to the other of the two side beams through the slender portion. The planar second moment of area and the polar second moment of area of any cross section of the support portion of the support beam are at least twice as great as the planar second moment of area and the polar second moment of area, respectively, of any cross-section of the slender portion of the support beam.

19 Claims, 4 Drawing Sheets

Fig. 7
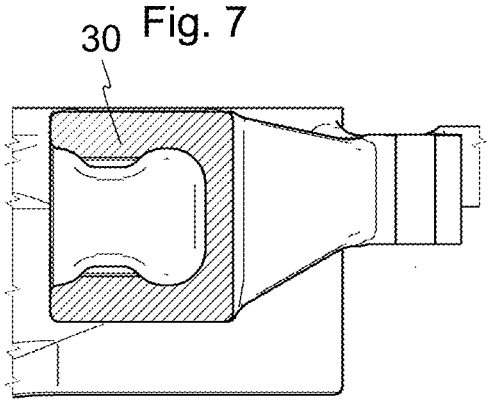
Fig. 8
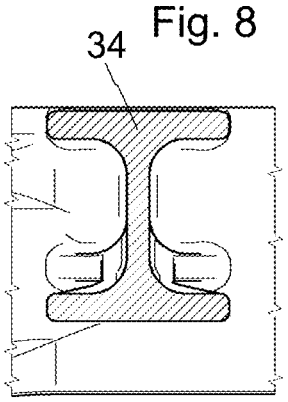
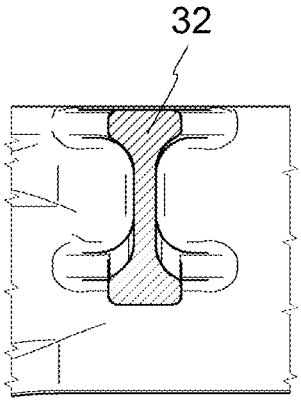
Fig. 9
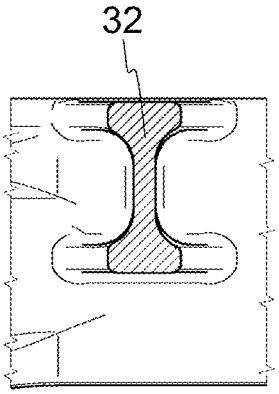
Fig. 10
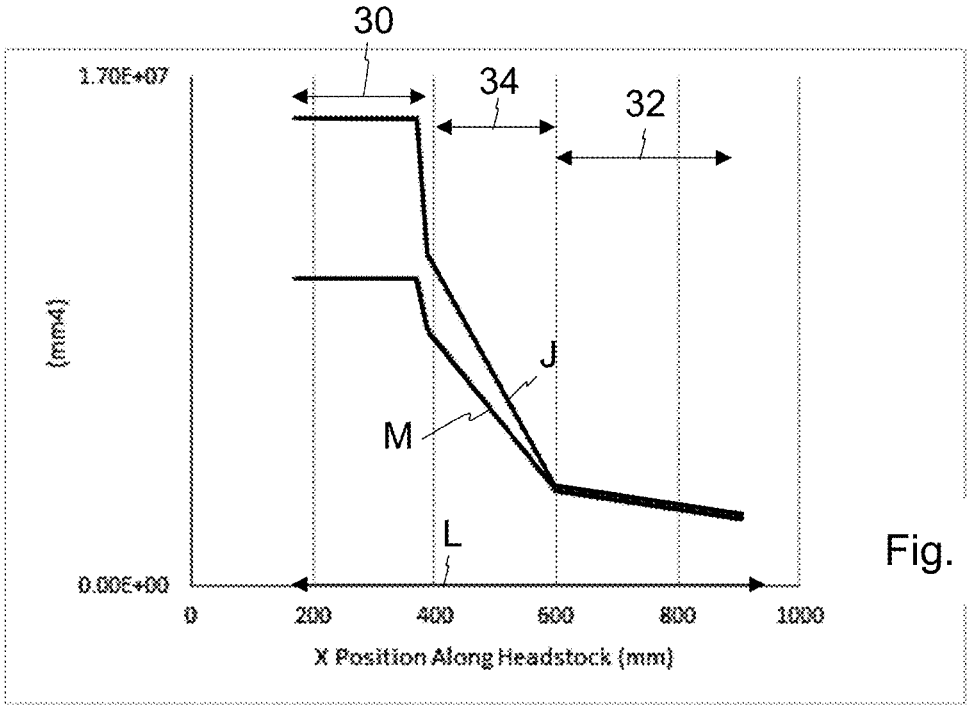
Fig. 11

BOGIE FRAME WITH ASYMMETRICAL SUPPORT BEAM AND BOGIE OF A RAIL VEHICLE

CROSS-REFERENCE TO RELATED APPLICATION

This application claims priority to United Kingdom Patent Application No. 1919475.2 filed Dec. 31, 2019, the disclosure of which is hereby incorporated by reference in its entirety.

BACKGROUND OF THE INVENTION

Field of the Invention

The present invention relates to a bogie frame and a bogie, particularly a motored bogie, for a rail vehicle.

Brief Description of the Background Art

The primary suspension located between the wheel bearings and the frame of a bogie plays a significant role in the compensation for track unevenness. The primary suspension needs to be soft enough to cope with track twist and avoid wheel unloading.

To achieve comparable roll performance, inboard bearing bogies with a narrow primary spring spacing need stiffer primary springs than outboard bearing bogie frames. To compensate for the increased spring stiffness, it is advantageous to have a torsionally soft bogie frame. However, a soft structure of the bogie frame may conflict with other functions of the bogie frame, in particular in the case of motored bogie, which have to support a drive unit including a motor and/or a gearbox.

Articulated bogie frames such as disclosed in U.S. Pat. No. 9,096,240 have been developed to overcome wheel unloading due to track twist. Such articulated bogie frames include at least two parts (or half frames) that are connected and articulated relative to one another about a pivot axis, more specifically about a horizontal transverse or longitudinal pivot axis. However, such articulated bogie frames are complex structures, which require a specific and costly maintenance of the pivot between the articulated parts of the bogie.

There is therefore a need for a motored bogie that combines a good roll performance and a good compensation for track unevenness.

SUMMARY OF THE INVENTION

According to a first aspect of the invention, there is provided a unitary bogie frame for a bogie of a rail vehicle, the unitary bogie frame including:

- at least two side beams extending in a longitudinal direction of the bogie frame, and spaced apart from one another in a transverse direction of the bogie frame, on respective left and right sides of a longitudinal median plane of the bogie frame, and
- at least one support beam extending in the transverse direction of the bogie frame, wherein the support beam is rigidly connected to each of the two side beams, and includes a support portion for supporting a drive unit of the bogie and a slender portion, wherein each cross-section of the support beam by a cross-sectional plane parallel to the longitudinal median plane has a planar second moment of area M and a polar second moment of area J, The support portion is directly connected to one of the two side beams and is connected to the other of the two side beams through the slender portion, wherein the planar second moment of area M and the polar second moment of area J of any cross section of the support portion of the support beam are at least twice as great, preferably at least 2.5 times as great, as the planar second moment of area M and the polar second moment of area J, respectively, of any cross-section of the slender portion of the support beam.

The bogie frame is unitary in the sense that it is not made of articulated parts. The bogie frame is designed as a torsional flexible structure in order to accommodate the large deflections at the primary suspension on twisted track. The stiffer support portion of the bogie frame allows for a rigid support of the drive unit, while the thinner slender portion provides a reduced stiffness of the bogie frame. The non-uniform support beam design enables a local deformation of the slender portion, which allows the frame to displace more freely whilst providing support for the gearbox loading.

The support section is preferably provided with a support interface, which may include one or more through holes for inserting connecting element for mounting the drive unit.

In order to evenly distribute torsional and flexural stress in the softer region of the support beam, the slender portion extends in the transverse direction over a length that is at least one third, and preferably at least two fifths of an overall length of the support beam measured in the transverse direction from one of the side beams to the other. Preferably, the support portion extends in the transverse direction over a length that is less than two fifths, and preferably less than one third of an overall length of the support beam measured in the transverse direction from one of the side beams to the other.

To avoid stress concentration, the support beam further comprises a transition portion extending from the support portion to the slender portion, wherein the planar second moment of area M and the polar second moment of area J of any cross section of the transition section decreases when the distance of the cross-section to the support portion increases.

In one embodiment, the polar second moment of area J of any cross section of the support portion of the support beam is at least three times as great as the polar second moment of area J of any cross-section of the slender portion of the support beam.

In a preferred embodiment, the unitary bogie frame comprises a further support beam extending in the transverse direction of the unitary bogie frame, wherein the support beam and the further support beam are spaced apart from one another in the longitudinal direction of the unitary bogie frame on respective front and rear sides of a transversal median plane of the unitary bogie frame, wherein the further support beam includes a further support portion for supporting the drive unit or a further drive unit and a further slender portion, the further support portion being connected to said one of the two side beams through the further slender portion and directly connected to said other of the two side beams, wherein each cross-section of the further support beam by a cross-sectional plane parallel to the longitudinal median plane has a planar second moment of area M and a polar second moment of area J, and the planar second moment of area M and the polar second moment of area J of any cross section of the further support portion of the further support beam are greater, at least twice as great as the planar second moment of area M and the polar second moment of area J, respectively, of any cross-section of the further slender portion of the further support beam.

In various embodiments, one or more of the following conditions are met:

- the support portion and the further support portion are located on opposite sides of the longitudinal median plane of the unitary bogie frame,
- the support beam and further support beam are symmetrical or substantially symmetrical relative to a vertical intersection axis between the longitudinal median plane and the transversal median plane of the unitary bogie frame,
- the support beam is closer to an end of the unitary bogie frame than to the median transverse plane,
- the further support beam is closer to a further end of the unitary bogie frame than to the median transverse plane,
- the unitary bogie frame comprises at least two secondary suspensions interfaces, each for accommodating a vertical spring of a secondary suspension, located at symmetric locations each on a respective side of the median longitudinal plane, each closer to the median transverse plane than the support beam and further support beam,
- the unitary bogie frame comprises at least two primary suspension interfaces, each of the primary suspension interfaces for accommodating a spring of a primary suspension, located at symmetric locations each on a respective side of the median longitudinal plane, each closer to the support beam than to the median transverse plane,
- the unitary bogie frame comprises at least two further primary suspension interfaces, each of the further primary suspension interfaces for accommodating a spring of a further primary suspension, located at symmetric locations each on a respective side of the median longitudinal plane, each closer to the further support beam than to the median transverse plane.

In one embodiment, the unitary bogie frame further comprises at least one median crossbeam extending from said one of the two side beams to the other, wherein the median crossbeam is located between the support beam and the further support beam, closer to the median transverse plane than the support beam and the further support beam, and each cross-section of the median crossbeam by a cross-sectional plane parallel to the longitudinal median plane has a planar second moment of area and a polar second moment of area, which are at least twice as great, preferably at least 2.5 times as great, as the planar second moment of area M and the polar second moment of area J, respectively, of any cross-section of the slender portion of the support beam. In one embodiment, the unitary bogie frame comprises a further median crossbeam extending from said one of the two side beams to the other, wherein the further median crossbeam is located between the support beam and the further support beam, the median crossbeam and further median crossbeam are located on both sides of the median transverse plane of the unitary bogie frame, closer to the median transverse plane than the support beam and the further support beam, and each cross-section of the further median crossbeam by a cross-sectional plane parallel to the longitudinal median plane has a planar second moment of area and a polar second moment of area, which are at least twice as great, preferably at least 2.5 times as great, as the planar second moment of area M and the polar second moment of area J, respectively, of any cross-section of the slender portion of the support beam. Because they are located closer to the centre of the bogie, the one or more median crossbeams do not need to be able to deform as much as the support beams.

Preferably, the bogie frame is provided with one or more of the following features:

- the unitary bogie frame is made in one piece;
- the unitary bogie frame is made of a single metallic material;
- the unitary bogie frame is made of steel;
- the unitary bogie frame is made of cast iron, preferably a spheroidal cast iron.

According to another aspect of the invention, there is provided a bogie for a rail vehicle comprising at least one set of wheels, a unitary bogie frame as disclosed hereinbefore supported on said at least one set of wheels and a drive unit attached to the support portion of the support beam of the unitary bogie frame. The drive unit may include a motor and/or a gearbox.

In one embodiment, the bogie further comprises wheel bearings for guiding a rotation movement of each wheel of the set of wheels about a spin axis, wherein the wheel bearings are located between the wheels of the set of wheels.

Preferably, the drive unit is also attached to the median crossbeam at two locations of the median crossbeam, wherein the two locations of the median crossbeam are located on both sides of the median longitudinal plane of the unitary bogie frame.

BRIEF DESCRIPTION OF THE FIGURES

Other advantages and features of the invention will then become more clearly apparent from the following description of a specific embodiment of the invention given as non-restrictive examples only and represented in the accompanying drawings in which:

FIG. 7 is a section of the support beam of FIG. 6 through line C-C of FIG. 5;

FIG. 8 is a section of the support beam of FIG. 6 through line D-D of FIG. 5;

FIG. 9 is a section of the support beam of FIG. 6 through line E-E of FIG. 5;

FIG. 10 is a section of the support beam of FIG. 6 through line F-F of FIG. 5;

FIG. 11 illustrates the a graphs of two functions, which associate a distance measured in the transverse direction of the bogie frame of FIG. 5 to a planar second moment of area and a polar second moment of area, respectively, of an associated cross-section of the support beam of FIG. 6.

Corresponding reference numerals refer to the same or corresponding parts in each of the figures.

DETAILED DESCRIPTION OF A PREFERRED EMBODIMENTS

Figure 1:
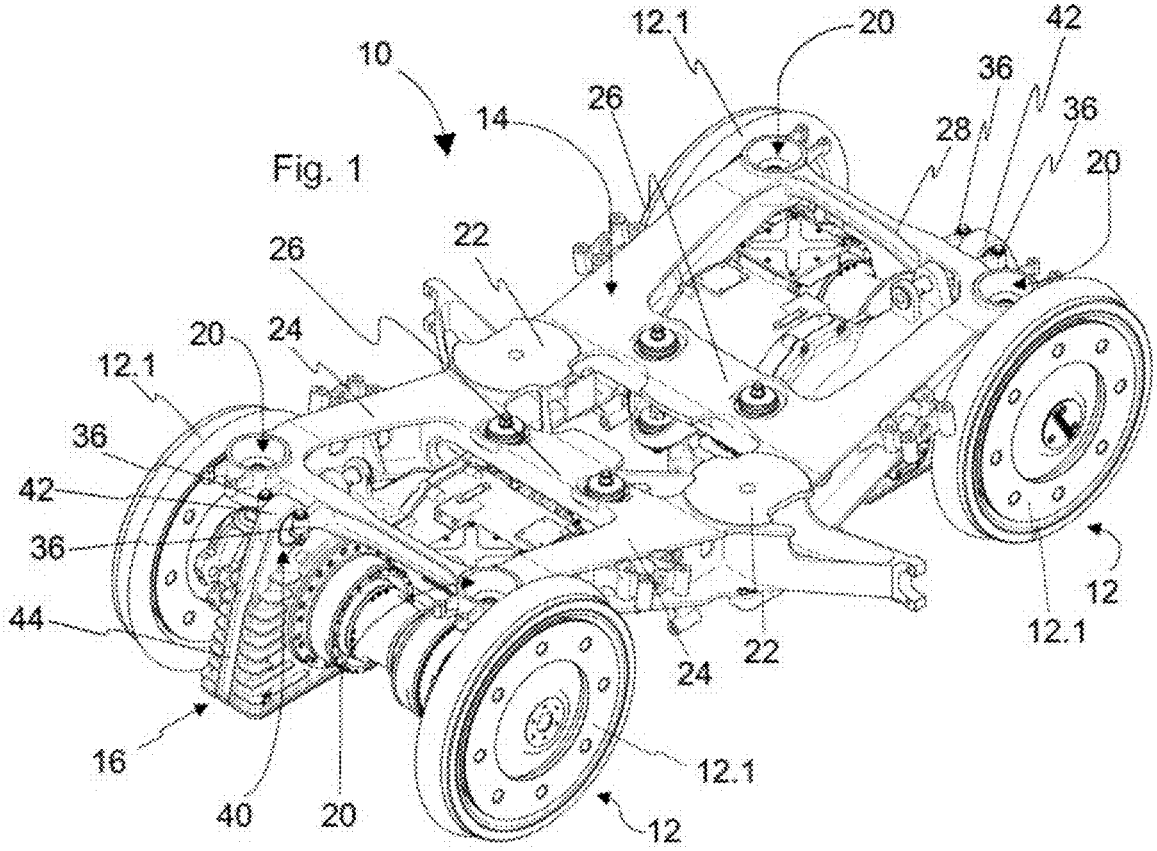
FIG. 1 is an isometric view of a bogie according to one embodiment of the invention.
Figure 2:
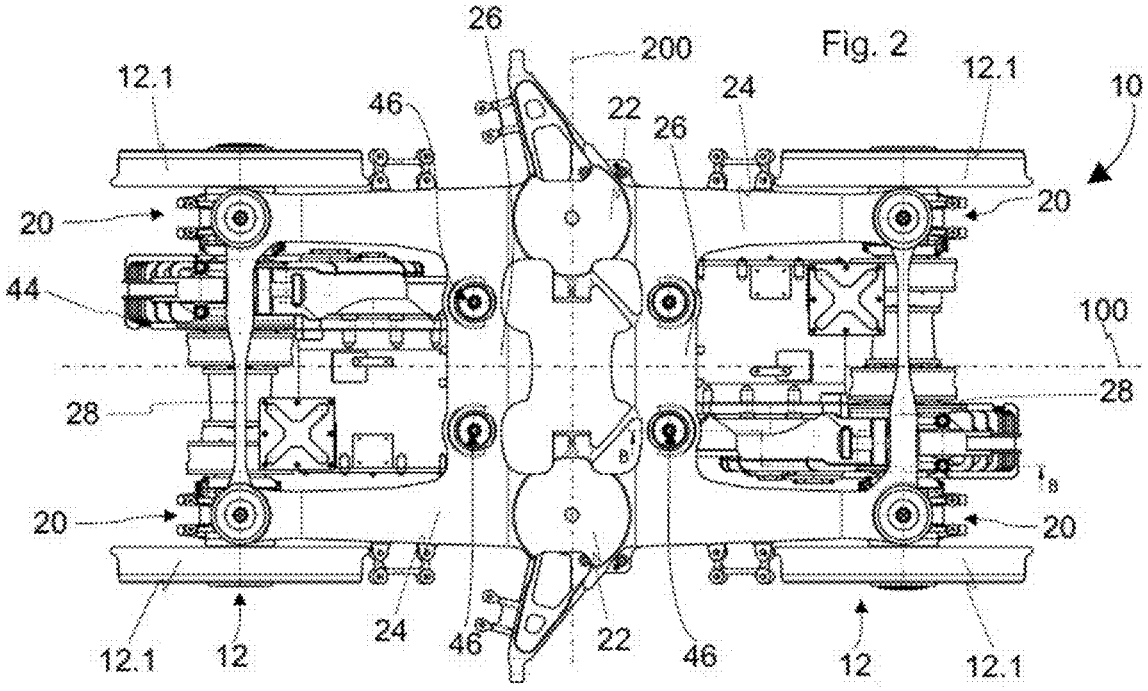
FIG. 2 is a top view of the bogie of FIG. 1.
Figure 3:
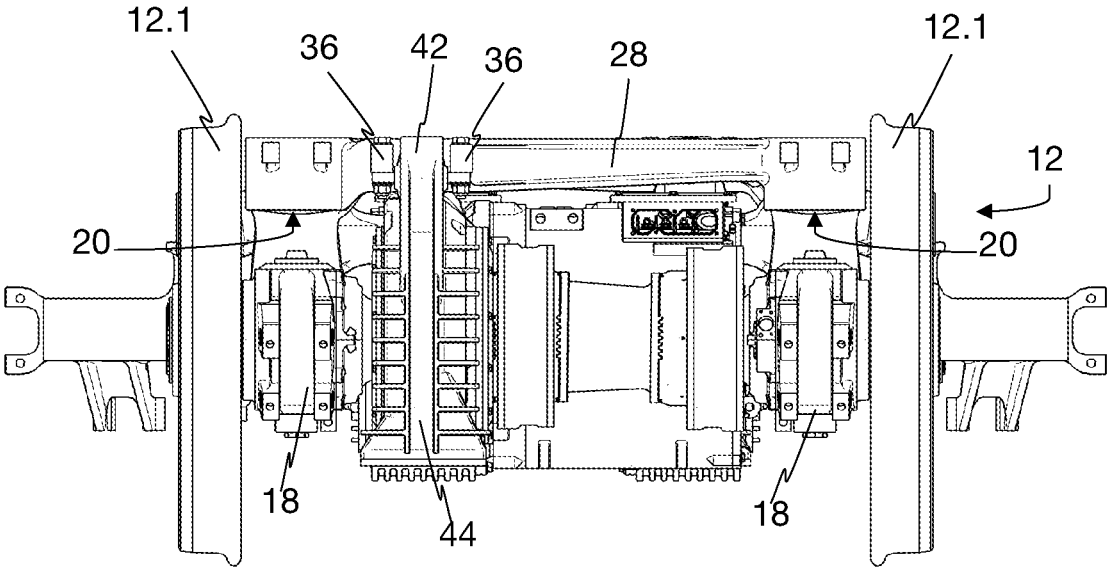
FIG. 3 is a front view of the bogie of FIG. 1.
Figure 4:
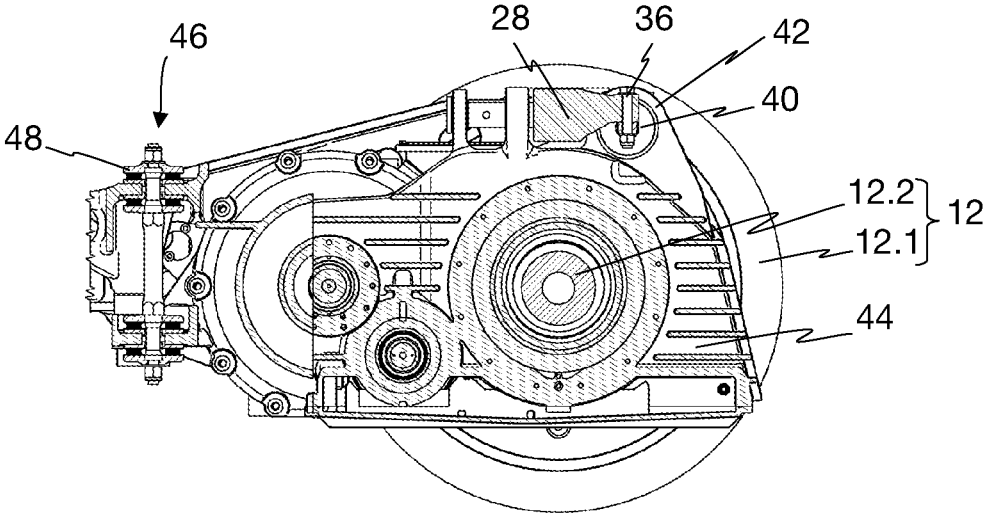
FIG. 4 is a sectional view of the bogie of FIG. 1 along the sectional lines B-B of FIG. 2.

With reference to FIGS. 1 to 4, a bogie 10 for a rail vehicle comprises two sets of left and right wheels 12, a unitary bogie frame 14 supported on the two sets of wheels 12 and two drive units 16 attached to the bogie frame 14, each for driving one of the sets of wheels.

Each set of wheels 12 consists of two wheels 12.1 mounted on a common axle 12.2. Two parallel wheel bearings 18 are located between the wheels 12.1 for guiding a rotation movement of each of the wheels 12.1 about a spin axis 100 of the axle 12.2. The bogie frame 14 comprises primary suspension interfaces 20 for mounting primary suspension elements (not shown) between the wheel bearings 18 and the bogie frame 14. The bogie frame further comprises two secondary suspensions seats 22, each for accommodating a vertical spring (not shown) of a secondary suspension, located at symmetric locations each on a respective side of a median longitudinal plane 100 of the bogie frame 14, each closer to a median transverse plane 200 of the bogie frame 14 than the primary suspension interfaces 20, and preferably centred relative to median transverse plane 200.

Figure 5:
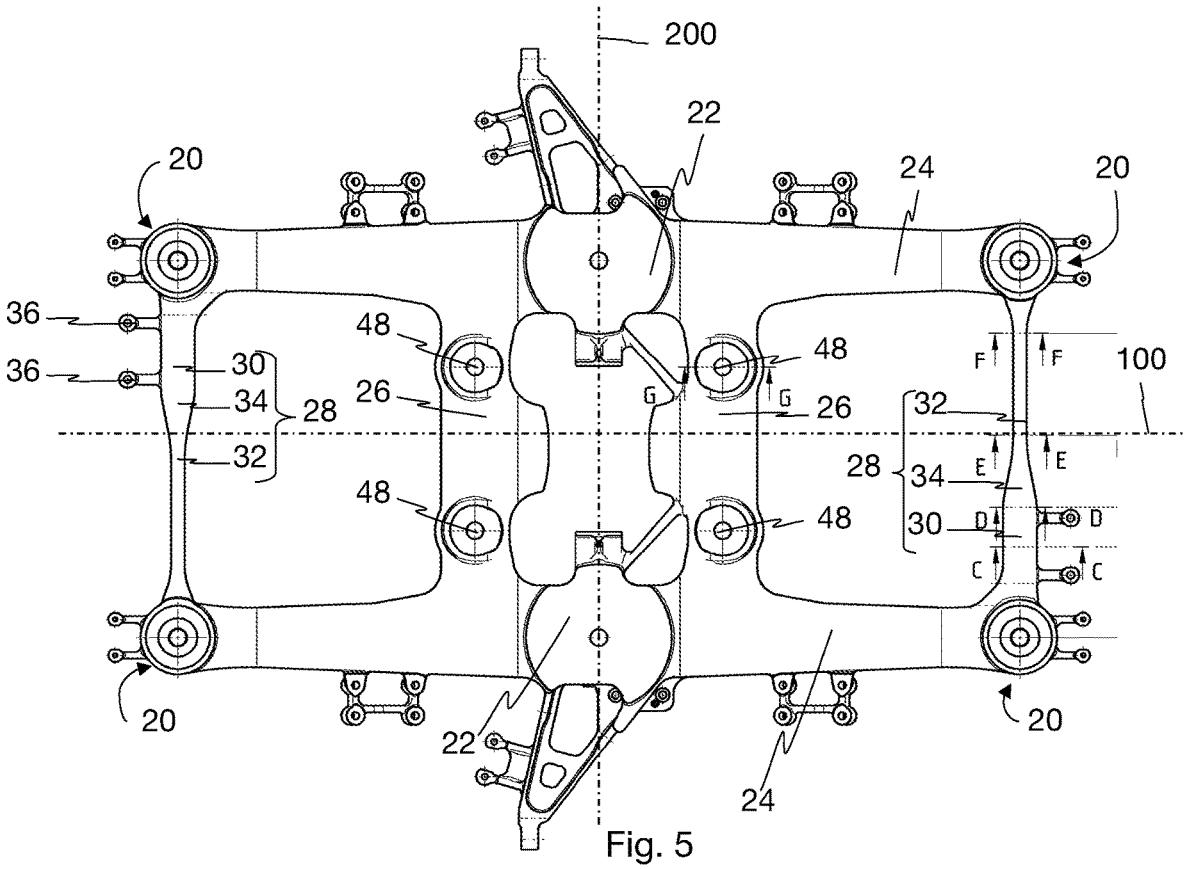
FIG. 5 is a top view of the frame of the bogie of FIG. 1.
Figure 6:
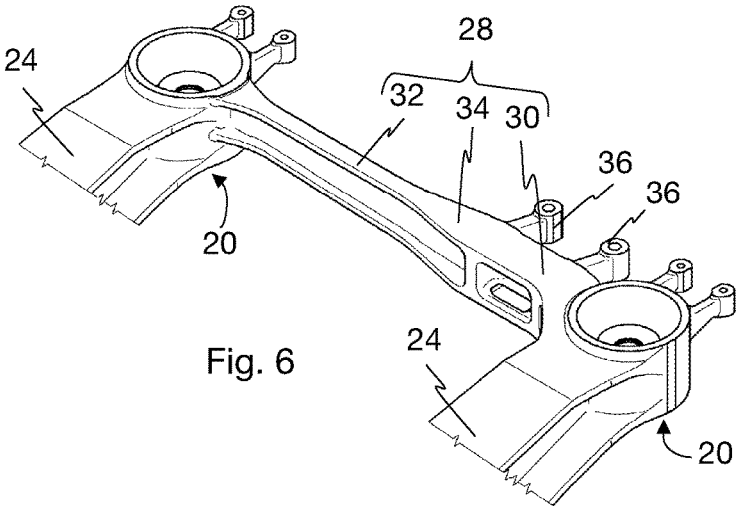
FIG. 6 is an isometric view of a support beam of the bogie frame of FIG. 5.

The bogie frame 14, illustrated in detail in FIGS. 5 to 10, can be made in one piece from steel or cast iron, preferably spheroidal cast iron. Alternatively, it can be made of several parts, which are welded or otherwise fixed to one another to build a unitary fabricated structure.

The bogie frame 14 includes two side beams 24, which extend in a longitudinal direction of the bogie frame 14 (i.e. a direction perpendicular to the median transverse plane 200) and are spaced apart from one another in a transverse direction of the bogie frame 14 (i.e. a direction perpendicular to the median longitudinal plane 100), on respective left and right sides of the longitudinal median plane 100. The ends of the side beams 24 extend above the wheel bearings 18 to form the primary suspension interfaces 20. The bogie frame further includes two median crossbeams 26 and two support beams 28 for connecting the two side beams 24 to one another. The median crossbeams 26 extend from one of the two side beams 24 to the other and are located between the two support beams 28, closer to the median transverse plane 200 than the support beams 28. The median crossbeams 26 have a substantially constant cross-section. The secondary suspension seats 22 are located on the side beams 24 between the median crossbeams 26. The support beams 28 extend in the transverse direction of the bogie frame 14, so as to connect the two side beams 24 with one another at a location close to the primary suspension interfaces 20 and to the ends of the side beams 28.

Each of the support beams 28 includes a support portion 30, a slender portion 32 and a transition portion 34 between the support portion 30 and the slender portion 32. The support portions 30 of the two support beams 28 are directly connected each to a different one of the two side beams 24, and indirectly connected to the opposite side beam 24 through the transition portion 34 and the slender portion 32. Each support portion 30 extends in the transverse direction over a length that is less than two fifth, and preferably less than one third of an overall length L of the support beam 28 measured in the transverse direction from one of the side beams 24 to the other. Each slender portion 32 extends in the transverse direction of the bogie frame over a length that is at least one third, and preferably at least two fifths of an overall length L of the support beam 28 measured in the transverse direction from one of the side beams to the other. The cross-sections of the slender portion 28 are preferably I-shaped, as illustrated in FIGS. 9 and 10. The slender portion 32 is blended into the end of the side beams 24 so as to avoid local stress concentration.

Each support portion 30 is provided with an attachment interface 36, which may include one or more through holes to attach the central pin of a rubber bushing 40 mounted in a through hole of a bracket 42 of a casing 44 of the drive unit 16. The casing 44 of each drive unit 16 is also attached to an associated one of the median crossbeams 26 by means of antivibration mountings 46 at two locations 48 of the median crossbeam 24, which are spaced apart from one another in the transverse direction and located on both sides of the median longitudinal plane 100 of the bogie frame 14. The rubber bushing 40 and antivibration mountings 46 provide a three-point suspension between the casing 44 of each drive unit 16 and the bogie frame 14 to minimise the transmission of high frequency vibration and allow for a limited freedom of relative motion in all direction.

The support portions 30 of the two support beams 28 are located on opposite sides of the longitudinal median plane 100 of the bogie frame 14. The two support beams 28 are preferably symmetric to one another relative to a vertical intersection axis 300 between the longitudinal median plane 100 and the transversal median plane 200 of the bogie frame 14.

Each cross-section of the support beam 28 by a cross-sectional plane parallel to the longitudinal median plane 100 (in particular the sections C-C to F-F of FIGS. 7 to 10) has a planar second moment of area M and a polar second moment of area J. The two graphs of FIG. 11 illustrates the planar second moment of area M and the polar second moment of area J, respectively, of a cross-section of the support beam 28, in relation to the distance to the side beam 24 closest to the support portion 30 of the support beam 28.

As can be seen on the graphs, the planar second moment of area M in the support portion 30 is at least twice as great as in the slender portion 32, while the polar second moment of area J in the support portion 30 is at least twice, and preferable at least 2.5 times a great as in the slender portion 32.

The planar second moment of area M and the polar second moment of area J are continuous, differentiable functions, which are preferably continuously decreasing in the transition portion 34 from the support portion 30 towards the slender portion 32.

The bogie frame is designed as a torsional flexible structure in order to accommodate the large deflections at the primary suspension on twisted track. The stiffer support portions 30 of the support beams 28 allow for a rigid support of the drive units 16, while the thinner slender portions 32 provides a reduced stiffness of the bogie frame 14. The non-uniform support beam design enables a local deformation of the slender portions 32, which allows the frame to displace more freely whilst providing support for the drive unit loading.

The invention is equally applicable to a bogie provided with independent wheels, i.e. with sets of wheels that are not connected to a common axle.

The two median crossbeams 28 can be replaced with a single crossbeam or be totally dispensed with.

The invention claimed is:

1. A unitary bogie frame for a bogie of a rail vehicle, the unitary bogie frame comprising:

at least two side beams extending in a longitudinal direction of the bogie frame, and spaced apart from one another in a transverse direction of the bogie frame, on respective left and right sides of a longitudinal median plane of the bogie frame, at least one support beam extending in the transverse direction of the bogie frame, wherein the support beam is rigidly connected to each of the two side beams, and includes a support portion for supporting a drive unit of the bogie and a slender portion, wherein each cross-section of the support beam by a cross-sectional plane parallel to the longitudinal median plane has a planar second moment of area and a polar second moment of area, wherein the support portion is directly connected to one of the two side beams and is connected to the other of the two side beams through the slender portion, wherein the planar second moment of area and the polar second moment of area of any cross section of the support portion of the support beam are at least twice as great as the planar second moment of area and the polar second moment of area, respectively, of any cross-section of the slender portion of the support beam, and a further support beam extending in the transverse direction of the unitary bogie frame, wherein the support beam and the further support beam are spaced apart from one another in the longitudinal direction of the unitary bogie frame on respective front and rear sides of a transversal median plane of the unitary bogie frame, wherein the further support beam includes a further support portion for supporting the drive unit or a further drive unit and a further slender portion, the further support portion being connected to said one of the two side beams through the further slender portion and directly connected to said other of the two side beams, wherein each cross-section of the further support beam by a cross-sectional plane parallel to the longitudinal median plane has a planar second moment of area and a polar second moment of area, and the planar second moment of area and the polar second moment of area of any cross section of the further support portion of the further support beam are greater, at least twice as great as the planar second moment of area and the polar second moment of area, respectively, of any cross-section of the further slender portion of the further support beam.

2. The unitary bogie frame of claim 1, wherein the slender portion extends in the transverse direction over a length that is at least one third of an overall length of the support beam measured in the transverse direction from one of the side beams to the other.

3. The unitary bogie frame of claim 1, wherein the support portion extends in the transverse direction over a length that is less than two fifths of an overall length of the support beam measured in the transverse direction from one of the side beams to the other.

4. The unitary bogie frame of claim 1, wherein the support beam further comprises a transition portion extending from the support portion to the slender portion, wherein the planar second moment of area and the polar second moment of area of any cross section of the transition section decreases when the distance of the cross-section to the support portion increases.

5. The unitary bogie frame of claim 1, wherein the polar second moment of area of any cross section of the support portion of the support beam is at least three times as great as the polar second moment of area of any cross-section of the slender portion of the support beam.

6. The unitary bogie frame of claim 1, wherein one or more of the following conditions are met:

the support portion and the further support portion are located on opposite sides of the longitudinal median plane of the unitary bogie frame, the support beam and further support beam are symmetrical or substantially symmetrical relative to a vertical intersection axis between the longitudinal median plane and the transversal median plane of the unitary bogie frame, the support beam is closer to an end of the unitary bogie frame than to the median transverse plane, the further support beam is closer to a further end of the unitary bogie frame than to the median transverse plane, the unitary bogie frame comprises at least two secondary suspensions interfaces, each for accommodating a vertical spring of a secondary suspension, located at symmetric locations each on a respective side of the median longitudinal plane, each closer to the median transverse plane than the support beam and further support beam, the unitary bogie frame comprises at least two primary suspension interfaces, each of the primary suspension interfaces for accommodating a spring of a primary suspension, located at symmetric locations each on a respective side of the median longitudinal plane, each closer to the support beam than to the median transverse plane; and the unitary bogie frame comprises at least two further primary suspension interfaces, each of the further primary suspension interfaces for accommodating a spring of a further primary suspension, located at symmetric locations each on a respective side of the median longitudinal plane, each closer to the further support beam than to the median transverse plane.

7. The unitary bogie frame of claim 1, wherein a median crossbeam is located between the support beam and the further support beam, closer to the median transverse plane than the support beam and the further support beam, and each cross-section of the median crossbeam by a cross-sectional plane parallel to the longitudinal median plane has a planar second moment of area and a polar second moment of area, which are at least twice as great as the planar second moment of area and the polar second moment of area, respectively, of any cross-section of the slender portion of the support beam.

8. The unitary bogie frame of claim 7, comprising a further median crossbeam extending from said one of the two side beams to the other, wherein the further median crossbeam is located between the support beam and the further support beam, the median crossbeam and further median crossbeam are located on both sides of the median transverse plane of the unitary bogie frame, closer to the median transverse plane than the support beam and the further support beam, and each cross-section of the further median crossbeam by a cross-sectional plane parallel to the longitudinal median plane has a planar second moment of area and a polar second moment of area, which are at least twice as great as the planar second moment of area and the polar second moment of area, respectively, of any cross-section of the slender portion of the support beam.

9. The unitary bogie frame of claim 1, provided with one or more of the following features:

the unitary bogie frame is made in one piece.

10. A bogie for a rail vehicle comprising at least one set of wheels, a unitary bogie frame supported on said at least one set of wheels and a drive unit attached to the unitary bogie frame for driving said at least one set of wheels, wherein the unitary bogie frame is a unitary bogie frame according to claim 1, and wherein the drive unit is attached to the support portion of the support beam of the unitary bogie frame.

11. The bogie of claim 10, further comprising wheel bearings for guiding a rotation movement of each wheel of the set of wheels about a spin axis, wherein the wheel bearings are located between the wheels of the set of wheels.

12. The bogie of claim 10, wherein the unitary bogie frame comprises a further support beam extending in the transverse direction of the unitary bogie frame, wherein the support beam and the further support beam are spaced apart from one another in the longitudinal direction of the unitary bogie frame on respective front and rear sides of a transversal median plane of the unitary bogie frame, wherein the further support beam includes a further support portion for supporting the drive unit or a further drive unit and a further slender portion, the further support portion being connected to said one of the two side beams through the further slender portion and directly connected to said other of the two side beams, wherein each cross-section of the further support beam by a cross-sectional plane parallel to the longitudinal median plane has a planar second moment of area and a polar second moment of area, and the planar second moment of area and the polar second moment of area of any cross section of the further support portion of the further support beam are greater, at least twice as great as the planar second moment of area and the polar second moment of area, respectively, of any cross-section of the further slender portion of the further support beam, and wherein the drive unit is also attached to the median crossbeam at two locations of the median crossbeam, and wherein the two locations of the median crossbeam are located on both sides of the median longitudinal plane of the unitary bogie frame.

13. The unitary bogie frame of claim 9, wherein the unitary bogie frame is made of a single metallic material.

14. The unitary bogie frame of claim 9, wherein the unitary bogie frame is made of steel.

15. The unitary bogie frame of claim 9, wherein the unitary bogie frame is made of cast iron.

16. The unitary bogie frame of claim 9, wherein the unitary bogie frame is made is spheroidal cast iron.

17. A unitary bogie frame for a bogie of a rail vehicle, the unitary bogie frame including:

at least two side beams extending in a longitudinal direction of the bogie frame, and spaced apart from one another in a transverse direction of the bogie frame, on respective left and right sides of a longitudinal median plane of the bogie frame, and at least one support beam extending in the transverse direction of the bogie frame, wherein the support beam is rigidly connected to each of the two side beams, and includes a support portion for supporting a drive unit of the bogie and a slender portion, wherein each cross-section of the support beam by a cross-sectional plane parallel to the longitudinal median plane has a planar second moment of area and a polar second moment of area, wherein the support portion is directly connected to one of the two side beams and is connected to the other of the two side beams through the slender portion, wherein the planar second moment of area and the polar second moment of area of any cross section of the support portion of the support beam are at least twice as great as the planar second moment of area and the polar second moment of area, respectively, of any cross-section of the slender portion of the support beam, the unitary bogie frame comprising a further support beam extending in the transverse direction of the unitary bogie frame, wherein the support beam and the further support beam are spaced apart from one another in the longitudinal direction of the unitary bogie frame on respective front and rear sides of a transversal median plane of the unitary bogie frame, wherein the further support beam includes a further support portion for supporting the drive unit or a further drive unit and a further slender portion, the further support portion being connected to said one of the two side beams through the further slender portion and directly connected to said other of the two side beams, wherein each cross-section of the further support beam by a cross-sectional plane parallel to the longitudinal median plane has a planar second moment of area and a polar second moment of area, and the planar second moment of area and the polar second moment of area of any cross section of the further support portion of the further support beam are greater, at least twice as great as the planar second moment of area and the polar second moment of area, respectively, of any cross-section of the further slender portion of the further support beam, the unitary body frame further comprising at least one median crossbeam extending from said one of the two side beams to the other, wherein the median crossbeam is located between the support beam and the further support beam, closer to the median transverse plane than the support beam and the further support beam, and each cross-section of the median crossbeam by a cross-sectional plane parallel to the longitudinal median plane has a planar second moment of area and a polar second moment of area, which are at least twice as great as the planar second moment of area and the polar second moment of area, respectively, of any cross-section of the slender portion of the support beam.

18. The unitary bogie frame of claim 17, wherein the unitary bogie frame is made in one piece.

19. The unitary bogie frame of claim 18, wherein the unitary bogie frame is made of steel, cast iron or spherical cast iron.

* * * * *